United States Patent [19]

Thekdi

[11] 3,951,584

[45] Apr. 20, 1976

[54] SELF-STABILIZING BURNER

[75] Inventor: Arvind C. Thekdi, Sylvania, Ohio

[73] Assignee: Midland-Ross Corporation, Cleveland, Ohio

[22] Filed: May 23, 1974

[21] Appl. No.: 472,532

[52] U.S. Cl. ..... 431/352; 431/173; 431/182

[51] Int. Cl.[2] ..... F23D 15/02

[58] Field of Search ..... 431/173, 182, 185, 167, 431/352, 249; 60/39.65

[56] References Cited

UNITED STATES PATENTS

| | | | |
|---|---|---|---|
| 1,910,735 | 3/1933 | Zikesch | 431/173 |
| 2,547,619 | 4/1951 | Buckland | 60/39.65 |
| 2,918,118 | 12/1959 | Schirmer | 431/352 |
| 2,973,727 | 3/1961 | Northcote | 431/173 |
| 3,244,219 | 4/1966 | Nesbitt | 431/352 |
| 3,256,924 | 6/1966 | Campbell et al. | 431/182 |

*Primary Examiner*—John J. Camby
*Assistant Examiner*—Henry C. Yuen
*Attorney, Agent, or Firm*—Frank J. Nawalanic

[57] ABSTRACT

A gas burner is provided with a rich combustion chamber contiguous with a second combustion chamber through which combustion air enters in predetermined flow patterns to enable the burner to be self-stabilizing in a highly efficient manner. The rich combustion chamber receives air through a first port arrangement which, among other things, establishes underpressure zones at the center of the rich combustion chamber and air layer zones thereabout. Combustion air is supplied to the second chamber by a second port arrangement which, among other things, assures thorough combustion therein independent of the burner firing rate. When a longitudinal stream of gaseous fuel is exhausted into the rich combustion chamber, the underpressure zones force same outwardly to mix with combustion air in the first chamber while positive pressure in the second chamber is effective to recirculate a portion of the mixture whereby a sufficient combustion level is achieved in the rich combustion chamber to minimize carbon formation while the air layer zones resulting from the first port arrangement assure that carbon will neither be formed nor deposited therein.

9 Claims, 3 Drawing Figures

FIG. 1
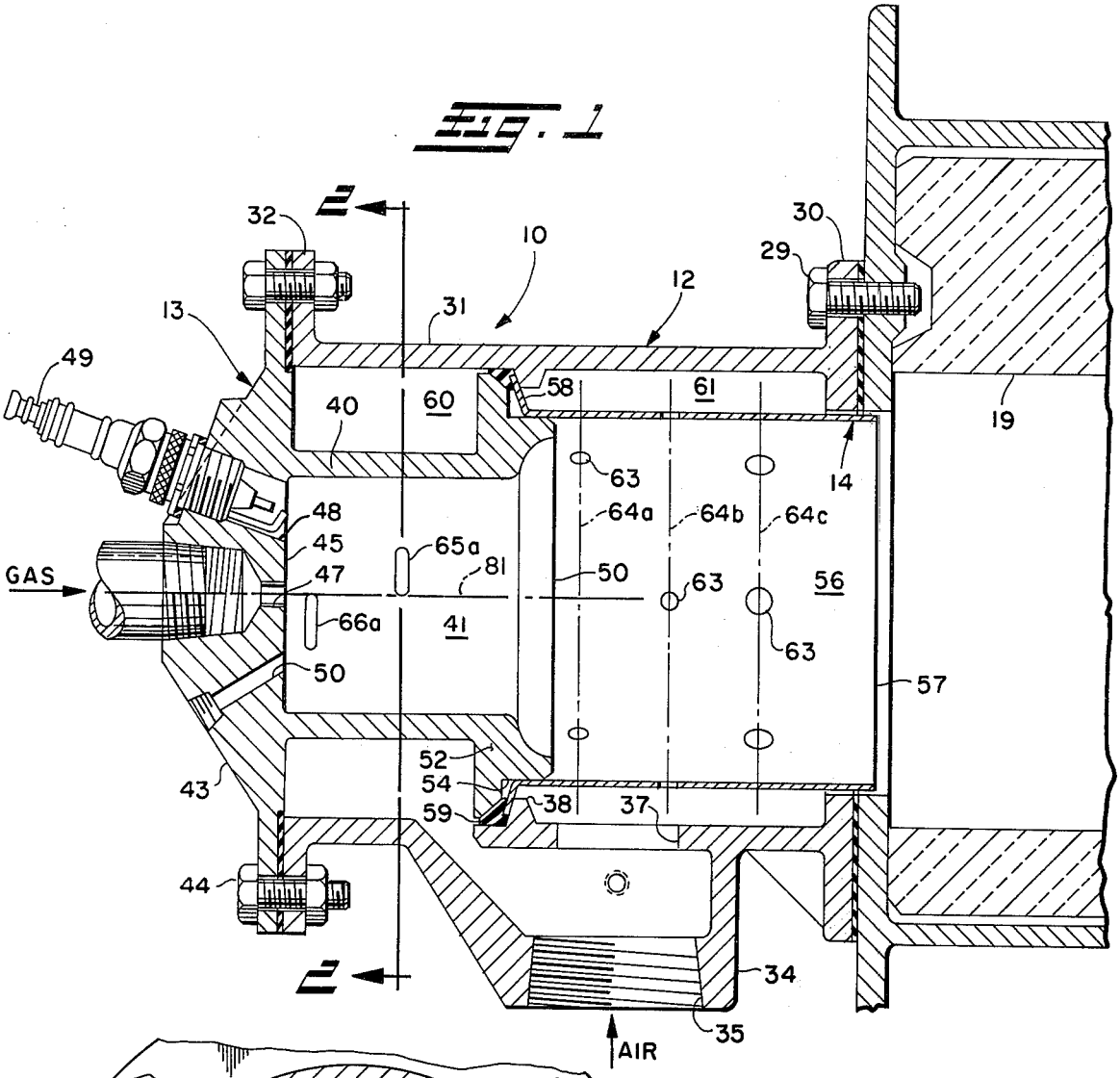
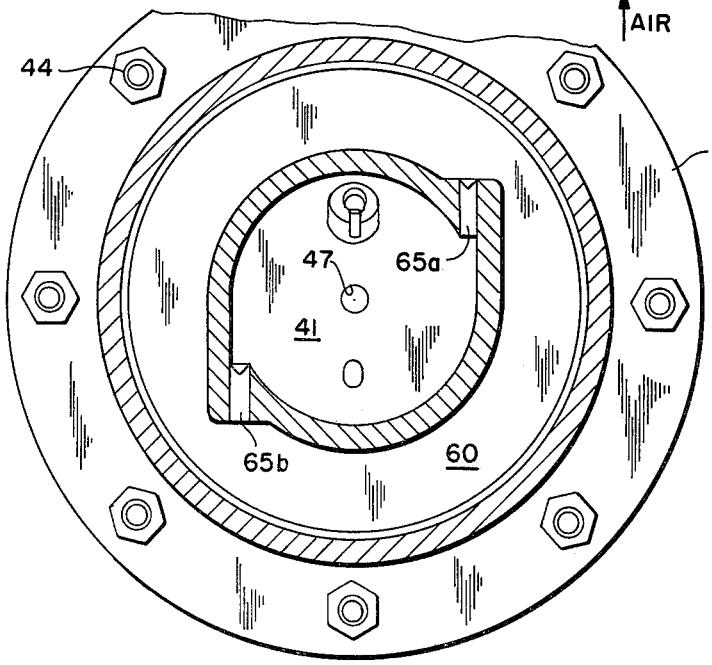
FIG. 2

SELF-STABILIZING BURNER

This invention relates generally to a gas burner and, more particularly, to a gas burner of the self-stabilizing type.

The invention is particularly applicable to a self-stabilizing gas burner which operates with excess amounts of combustion air and will be described with particular reference thereto. However, it will be appreciated by those skilled in the art that the invention may have broader application and may in some instances be used with combustion air which is oxygen-enriched or combustion air monitored to the burner in predetermined stoichiometric flow relationship to that of the gas metered therein.

Heretofore, burners have frequently stabilized the flame propagated therein by means of a separate combustion system, normally of the premixed type, which was used as a piloting system. Such piloting systems are expensive in cost and maintenance and, importantly, give rise to certain well recognized safety hazards which may result in an explosion under certain circumstances if the pilot is extinguished. Accordingly, recent safety regulations have, in effect, abolished the use of continuous pre-mix pilot systems and have required burner designs to be self-stabilizing.

One type of self-stabilizing burner design which satisfies safety regulations and has met with success is disclosed in U.S. Pat. No. 3,244,219 which is assigned to the present assignee. The invention disclosed herein may be viewed as an improvement over the U.S. Pat. No. 3,244,219.

Briefly, the embodiments disclosed in the U.S. Pat. No. 3,244,219 employ a stream of air directed tangentially within a cylindrical tube to circumscribe an axial flow of gas entering through the center thereof. This provides a rich fume mixture which is ignited by a conventional sparkplug and propagated lengthwise down the burner tube by a variety of tube shapes and apertures therein. The controllability of the rich fume combustion in such arrangements may be described as being sensitive in nature. That is, slight variations in fuel or air flow into the burner could result, because stabilization occurred at the closed inlet wall of the burner, in some instances, in an incomplete combustion of the rich fume mixture to the extent that carbon could be formed and the presence of aldehydes detected. The carbon formed would eventually block certain flow and air passages necessitating cleanout of the burner. As a result of this tendency to form carbon, such burners could be utilized only with low hydrocarbon fuels, such as methane, as the use of higher numbered hydrocarbon fuel, such as propane or butane, would produce excessive carbon formation within a relatively short period of time. Furthermore, the embodiments illustrated in the U.S. Pat. No. 3,244,219 patent which utilize solely orifice arrangements in the complete combustion chamber require the air to be throttled before the rich fume mixture is ignited.

It is thus an object of the subject invention to provide an efficient, self-stabilizing burner arrangement which mixes combustion air with gaseous fuels in a predetermined manner to establish a rich fume mixture which, when ignited, minimizes carbon formation within the burner while also providing an air orifice arrangement downstream of the rich fume formation promoting thorough combustion of the rich mixture.

This object along with other features of the subject invention is achieved in a burner arrangement defined by a housing having a first, cylindrical, rich combustion chamber contiguous, at its downstream end, with a second complete combustion chamber. The inlet end for the rich combustion chamber is a closed end wall except for a central opening through which a longitudinal stream of gaseous fuel is directed and a second opening removed from the central opening into which a conventional igniter such as a sparkplug is inserted. A first combustion air port arrangement is provided to introduce a predetermined amount of air into the rich combustion chamber which mixes with the gaseous fuel directed therein in a highly efficient manner to promote a rich combustion minimizing the formation of carbon soot therein. The first port arrangement includes at least a first tangential air port spaced closely adjacent the gas inlet and a second tangential port axially spaced from and oppositely orientated to the first port. When air under pressure is circulated through the first and second ports, the gaseous fuel is aspirated radially outwardly to be entrained within air and improved mixing with the air injected through the ports occurs at approximately the mid point between the first and second ports whereat stabilization and ignition occurs. Importantly, the port arrangement produces a layer of air about the rich combustion chamber's walls which may be viewed as impervious to fuel penetration or, alternatively, as spent gas incapable of supporting combustion thereby tending to prevent carbon formation and/or carbon deposit in the rich combustion chamber.

In accordance with another feature of the subject invention, the complete combustion chamber is cylindrical in shape and of greater diameter than the rich combustion chamber to cause the flame propagated in the rich combustion chamber to tend to expand further radially outwardly as it travels the length of the complete combustion chamber. Additional air to insure thorough combustion while functioning also as a cooling means for the second chamber is provided by a second port arrangement which includes a plurality of openings extending through the complete combustion chamber in axially spaced arrays therealong. Each array has an increasing plurality of circumferentially spaced openings when compared to the adjacent array spaced closer to the rich combustion chamber to supply increasing amounts of combustion air to the air-fuel mixture which, besides insuring thorough combustion, controls the size and shape of the propagated flame thus lending the burner to a wide variety of applications. Importantly, the second port arrangement provides positive pressure within the complete combustion chamber which is effective to recirculate a portion of the fuelair mixture back into the rich combustion chamber since the rich combustion chamber is at an underpressure by virtue of its first and second tangential ports.

In accordance with yet another feature of the subject invention, the entire burner is comprised simply of three pieces, a rich combustion chamber casting, a combustion chamber tube and a mounting casting. The rich combustion casting is easily bolted to the mounting casting section to define the exterior of the burner and respective flanges provided in all three pieces are sealed together by a simple rope gasket to define the assembled burner. Once assembled, first and second pressure chambers in fluid communication respectively with first and second port arrangements and with a common air inlet are formed. Importantly, an orifice is provided in the structure to place the complete combustion chamber at a lower pressure than the rich combustion chamber to assure proper flame stabilization within the burner.

It is thus seen that while each of the three abovementioned features in and of themselves contributes an improvement to the burner art, all three interact with one another in dependent relationships to produce a highly efficient burner because of the air-fuel mixing characteristics therein.

It is thus another object of the subject invention to provide in a selfstabilizing gas burner, highly efficient mixing means which permits said burner to be used with high numbered hydrocarbon fuels such as propane and butane without significant carbon deposits therein.

It is yet another object of the subject invention to provide a selfstabilizing burner which may be easily constructed from three separate pieces.

Still a further object of the subject invention is to provide in a self-stabilizing gas burner, combustion air port means for directing air flow therein in a predetermined manner to provide an extremely stable burner arrangement.

Yet another object is to provide an air port arrangements in burner apparatus which causes the burner flame to be stabilized and ignited out in space while simultaneously providing an air flow layer about the burner walls tending to prevent carbon formation.

The invention may take physical form in certain parts and arrangement of parts, a preferred embodiment of which will be described in detail herein and illustrated in the accompanying drawings which form a part hereof and wherein:

FIG. 1 is a longitudinally-sectioned view of a gas burner embodying the subject invention;

FIG. 2 is a cross-sectional view of the burner taken generally along line 2—2 of FIG. 1.

Figure 3:
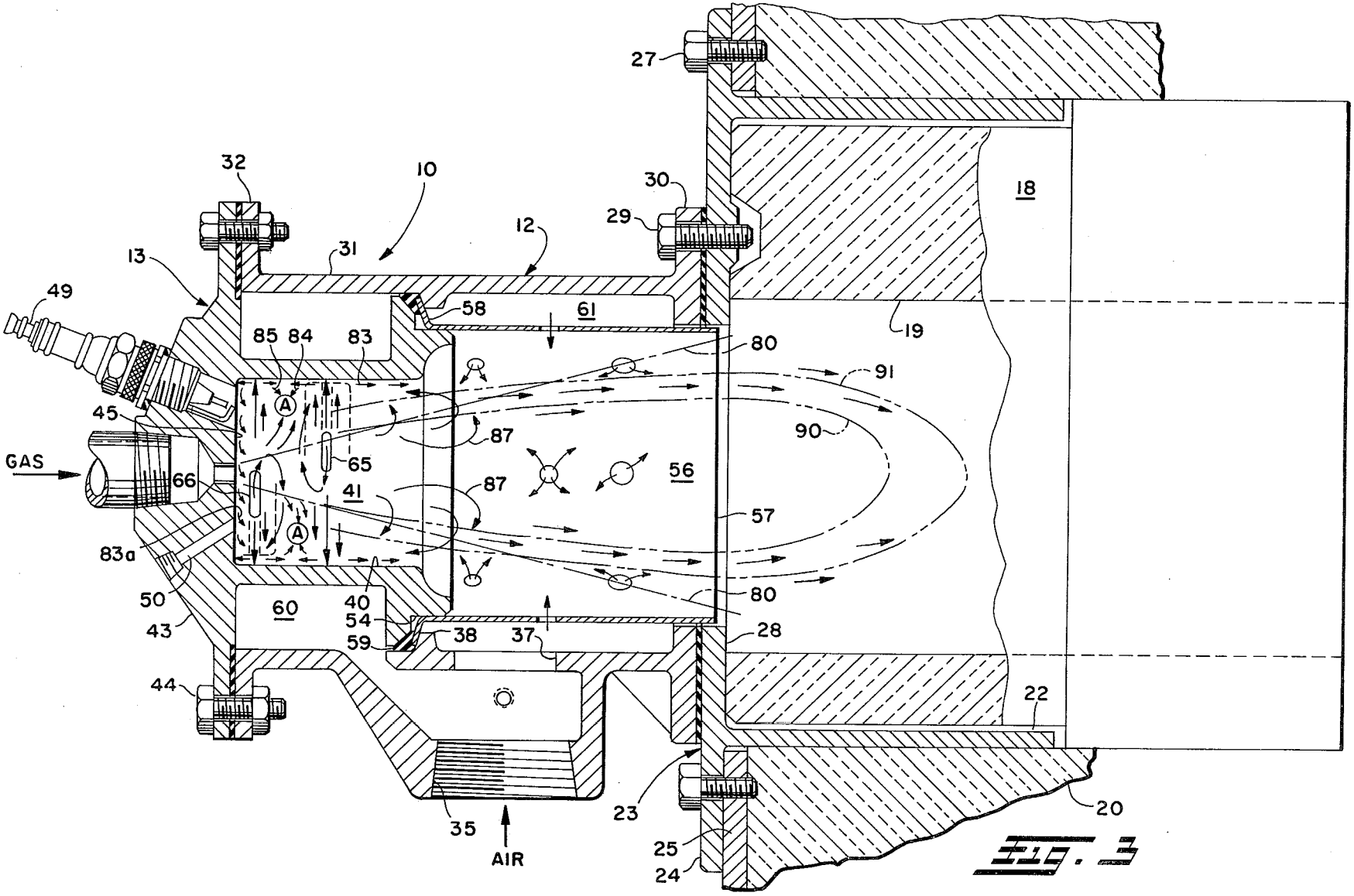
FIG. 3 is a view similar to FIG. 1 showing the flow paths believed to exist in the burner when same is operated.

Referring now to the drawings wherein the showings are for the purpose of illustrating a preferred embodiment of the invention only and not for the purpose of limiting same, there is shown in FIG. 1 a self-stabilizing gas burner 10 generally comprised of a cast steel housing section 12, a cast steel rich combustion chamber section 13 and a stainless steel combustion chamber tube section 14.

Burner 10 is shown in FIG. 3 installed in a furnace wall or insulated enclosure in a typical application, such as a tempering furnace. This is accomplished in the usual manner by means of a tunnel block 18 although an alloy tube may be used in place of block 18 for low temperature applications. Block 18 is generally square in exterior configuration and has a cylindrical tunnel chamber 19 extending longitudinally therethrough. Tunnel block 18 is made of conventional refractory material and inserted within the refractory material of the furnace wall 20 and secured by suitable means to burner 10. More particularly, tunnel block 18 is cemented in place to longitudinally extending walls 22 of a cast steel block holder 23. Block holder 23 in turn has a radially outwardly extending flange portion 24 which is secured to the exterior steel furnace lining 25 by a plurality of circumferentially spaced fasteners 27. Block holder 23 also has a radially inwardly extending flange portion 28 which is fastened to a flanged end 30 of housing section 12 by a plurality of circumferentially spaced bolts 29. Flanged end 30 may be modified somewhat to adapt burner 10 to other burner applications such as a radiant tube heater, immersion tube heater, etc. as same will suggest themselves to others skilled in the art and thus not shown nor described further in detail herein.

Referring now to FIG. 1, housing section 12 may best be defined as including a cylindrical body portion 31 with flanged end 30 extending from the rear of body portion 31 and a second flanged end 32 extending from the front of body portion 31. An outwardly extending, somewhat cylindrical housing portion 34 extends from body portion 31 and has a threaded opening 35 to receive a source of combustion air (not shown) at a predetermined pressure. Axially aligned with threaded opening 35 is an orifice opening 37 in cylindrical body portion 31, which function will be explained hereafter. Extending inwardly from body portion 31 and in between flanged ends 30, 32 is an annular sealing shoulder 38.

Rich combustion section 13 is similarly defined by a cylindrical, longitudinally extending wall portion 40 which in turn defines a first cylindrical or rich combustion chamber 41 of gas burner 10. At the forward end of wall portion 40 is a flanged end cap portion 43 which is secured to flanged end 32 of cast housing 12 by a plurality of bolts or fasteners 44 as shown. End cap portion 43 defines a closed inlet end wall 45 of rich combustion chamber 41 into which a centrally disposed nozzle opening 47 is provided through which a stream of gaseous fuel will flow longitudinally into rich combustion chamber 41. Spaced from nozzle opening 47 is a second opening 48 which receives in threaded engagement therewith a conventional sparkplug 49 which serves as igniter means for the fuel mixture within rich combustion chamber 41. Also spaced from nozzle opening 47 is a third opening 50 which is adapted to threadedly receive a known, commercially available, flame detection safety device such as an ultraviolet detector head or flame rod (not shown). At the rearward end of longitudinally extending wall portion 40 or at the exit end 50 of rich combustion chamber 41 is a flanged end portion 52 which extends radially outwardly to be closely adjacent to the interior of body portion 31 of housing casting 12. Flanged end portion 52 is also axially aligned to be closely adjacent to annular sealing shoulder 38 extending from body portion 31 and is provided with an annular step as at 54 to receive a portion of combustion tube section 14.

Combustion tube 14 is by definition cylindrical and thus defines a second cylindrical or complete combustion chamber 56 therein. Combustion tube 14 has an exit end 57 extending slightly beyond flanged end 30 of housing section 12. The opposite end of combustion tube 14 is formed as an outwardly flared flanged end 58 which is adapted to seat against annular sealing shoulder 38 of housing casting 12. A suitable rope-type gasket 59 interposed between flared end 58 of the combustion tube and flanged end 52 of the rich chamber casting is compressed when bolts 44 are tightened to provide a seal between rich combustion chamber 41 and complete combustion chamber 56. It should be noted that because all three sections 12, 13, 14 are steel, gas burner 10 of the subject invention is ideally suited for use in the food processing and other industries where refractory abrasion in a burner with refractory block may introduce intolerable contaminants.

With sections 12, 13, 14 thus assembled, a first annular chamber 60 is formed by housing section 12 and rich combustion section 13 and surrounds rich combustion chamber 41. Similarly, a second annular chamber 61 surrounds complete combustion chamber 56 and is defined by the space between housing section 12 and combustion tube section 14. As shown in FIG. 1, first annular chamber 60 is in fluid communication with threaded air inlet opening 35 and because of the width of cylindrical air inlet housing portion 34 (not shown), a pressure drop does not exist in chamber 60 when compared to the pressure existing at air inlet opening 35. Second annular chamber 61 is in fluid communication with threaded air inlet opening 35 through orifice 37 and is thus at a lower pressure than that existing at air inlet opening 35 or at first annular chamber 60.

Combustion air in second annular chamber 61 is in fluid communication with complete combustion chamber 56 by second port means defined by a plurality of apertures 63 extending through combustion tube 14. Apertures 63 are spaced in equal circumferential increments in axially spaced arrays, i.e., 64*a*, 64*b*, 64*c*, extending along the length of combustion tube 14. Importantly, the number of apertures 63 in each array increases the further away the array is spaced from rich combustion chamber 41, i.e., 64c has a greater total aperture area than 64*b* which in turn has a greater area than 64*a*.

As best seen in FIGS. 1 and 2, first annular chamber 60 is in fluid communication with rich combustion chamber 41 by first port means shown herein to include axially spaced first and second tangential port arrays 65, 66. Each tangential port array 65, 66 introduces combustion air into chamber 41 in rotational direction which is opposite from the other. Furthermore, each tangential array is shown to consist of two ports, i.e., 65*a*, 65*b* and 66*a*, 66*b* (FIG. 2) which are circumferentially spaced (180° apart) about rich combustion chamber 41 and the ports in one array are equally offset from the ports in the other array, i.e., 66*a* is offset from 65*a* by 90°, etc.

Referring now to FIG. 3, the operation of burner 10 will now be described as it is best believed to operate with reference to the fuel and air paths therein. Neglecting initially any considerations of combustion air flow into burner 10, it should be apparent that gaseous fuel leaving nozzle opening 47, under a slight pressure, will expand radially outwardly at increasing distances as the gas longitudinally travels through rich combustion chamber 41 and complete combustion chamber 56. Generally, the gas (within limits) will be confined between the dot-dash lines shown as 80 in FIG. 3 and the characteristics of this flow distribution in accordance with known theories will be dependent upon the pressure of the gas, nozzle and chamber diameters and effective chamber lengths. The introduction of combustion air into rich combustion chamber 41 and complete combustion chamber 56 may be viewed as modifying the nozzle gas distribution to achieve thorough and stable intermixing of fuel and air in accordance with the invention.

Viewing now the introduction of combustion air into rich combustion chamber 41 and the effect thereof on the nozzle gas distribution (i.e., line 80), it is again noted that air in first chamber 60 introduced into tangential port arrays 65, 66 is at the same pressure as that introduced into air inlet 35. Tangential ports 65*a*, *b* and 66*a*, *b* are perpendicular to the gas burner longitudinal centerline 81 and direct the air tangentially about the diameter of rich combustion chamber 41. The rotational flow of combustion air about rich combustion chamber 41 creates a vortex at the center of the chamber which establishes an underpressure thereat; such underpressure believed to be gradually reduced at points spaced progressively radially outwardly from center 81. This underpressure, in itself, is sufficient to cause the gas flow to assume an annular configuration which is drawn radially outwardly and entrained with the combustion air from ports 65, 66; such annular flow being defined in a general sense by dot-dash lines 90, 91 in FIG. 3. It is a specific feature of the present invention, however, to provide an efficient, stabilized mixing of air and fuel in rich combustion chamber 41 and minimize the tendency of carbon formation therein. To this end, two port arrays 65, 66 are provided and the air introduced therein rotates in counterflow relation to one another. More particularly, it should be apparent that the tangential flow of air introduced into chamber 41 at ports 65*a*, *b* and 66*a*, *b* must eventually propagate in an axial direction along the inner surface of longitudinally extending wall 40. This propagation is believed to be generally a laminar type flow which defines a boundary layer of air designated generally by number 83 in FIG. 3. Because two axially spaced ports 65, 66 are used, it necessarily results that the boundary layer flow of air will interact therebetween at approximately the mid point, i.e., as shown by air flow arrows 84, 85 in FIG. 3, and will produce a zone, designated as A in FIG. 3, of some turbulence whereat combustion air and a portion of the fuel will mix with one another to effect a stoichiometric relationship sufficient to support combustion. More particularly, the stoichiometric mixture of fuel and combustion air will be formed within some discreet portion of zone A which will, for all intents and purposes, be at zero flow and thus capable of being ignited independent of the firing rates of the burner. Once ignited, the stable flow patterns thus produced at zone A maintain the combustion.

Tests have shown that the stability and ignition characteristics of the burner are enhanced when the air flow through the ports 65, 66 are counter to one another as disclosed. Furthermore, the extent of mixing and, accordingly, combustibility of the mixture within rich combustion chamber 41 is dependent, all other things being equal, upon the axial spacing of ports 65, 66. That is, the closer the ports are spaced to one another, the more profound zone A will become. Similarly, the farther apart the ports are spaced, the less profound the reaction in zone A will become and limits are believed associated with the positioning of the ports to provide an optimum zone of reaction.

Also inherent to the flow paths discussed above is that air from the ports will establish some form of backpressure which, among other things, directs a layer of air shown as 83*a* in FIG. 3 against the closed inlet end wall 45 of rich combustion chamber 41. Air layer 83*a* may, in fact, be spent gas insufficient to support combustion. In any event, the effect of air layer 83*a* against the end walls and air layer 83 about the inner circumference of chamber 41 has been found to be effective in preventing the combustible mixture of fuel and air from contacting walls 40, 45 of rich combustion chamber 41 while still permitting the spark generated from a conventional sparkplug or igniter means 49 to penetrate therethrough and ignite the mixture within rich combustion chamber 41. Thus the flame propagated in a stabilized manner within rich combustion chamber 41 as explained above does not contact the walls of that chamber and carbon formation tending to occur from the products of incomplete combustion contacting the relatively cool walls of the burner is minimized. It should be noted for purposes of contrast that if only one port array, 65 or 66, were used in the burner illustrated, that stoichiometric mixing and stabilization would eventually occur at the closed inlet end wall 45 of chamber 41 and any tendency of the flow to form air layers sufficient to prevent or retard carbon formation would be minimized. It should also be noted that port array 66 is spaced a predetermined distance from end wall 45 and that the closer port array 66 is spaced to wall 45 the more effective air layer 83*a* will become.

It is thus seen that the use of two tangential air support ports in rich combustion chamber 41 causes (a) a stabilization zone A at approximately the center therebetween whereat the fuel becomes entrained within the air in a mixture which can be ignited and once ignited maintains combustion while (b) air flow patterns 83, 83*a* are established which tend to prevent the gaseous fuel and air mixture from contacting the walls of rich combustion chamber 41 to prevent flame propagation thereat which, because of the relative coldness of the burner walls, would otherwise tend to form carbon deposits and that (c) these reactions, a and b, are considerably enhanced when the flow through port arrays 65, 66 are countercurrent to one another.

The mixing characteristics of the air and fuel within rich combustion chamber 41 are further enhanced when the effect of flow in complete combustion chamber 56 is considered. As noted above, air under positive pressure in second chamber 61 flows through apertures 63 into complete combustion chamber 56. One of the effects of air flow through such apertures into complete combustion chamber 56 is to place chamber 56 at a positive pressure. Thus there is a pressure differential between complete combustion chamber 56 and rich combustion chamber 41 which differential is effective to cause the gaseous fuel, which may not have been aspirated with the air in rich combustion chamber 41, to be recirculated back into rich combustion chamber 41 for mixing with combustion air therein. This recirculation back is indicated by flow arrows 87 in FIG. 3.

The primary effect of air flow in chamber 56 is to achieve a complete and thorough combustion of the gaseous fuel-air mixture leaving rich combustion chamber 41 by further entrainment with additional quantities of combustion air to achieve efficient operation of the burner. The spacing of apertures 63 into axially spaced arrays 64*a*, 64*b*, etc. is believed to accomplish this function in an efficient manner. That is, introducing increasing volumes of air at spaced intervals along the length of combustion tube 14 correspondingly increases the intensity of the flame therealong as the air volume is sequentially increased to assure thorough stoichiometric mixing of air and fuel. While accomplishing this function, the air flow through the apertures similarly provides for increased cooling of the tube at the same points therealong that the intensity of the flame is increased. In this connection, it should be noted that while air entering air apertures 63 will cool combustion tube 14, it will not be of sufficient intensity to extinguish or impede the propagation of the burner flame since the air is passed through orifices 37 to reduce its pressure to a predetermined value. Thus the three-piece burner configuration, besides its simplicity of design and ease of assembly, enables the burner to be operated in a stable and efficient manner. Finally, increasing the volume of air flow into complete combustion chamber 56 by spaced arrays 64*a*, *b*, *c*, modifies the shape of the flame propagated to cause same to be inwardly displaced from theoretical line 80 and out of contact with combustion tube 14 while causing the apex of the flame to be positioned within tunnel block chamber 19. Accordingly, it is believed the flame configuration could be modified from a short profile to a long profile to adapt burner 10 to a wide variety of applications.

Burner 10 is thus characterized as being a self-stabilizing burner which is highly efficient. That is, the rich combustion chamber arrangement described by itself establishes an air layer zone preventing flame contact against the chamber walls which, because of the coolness thereof, leads to carbon formation. Furthermore, the rich combustion chamber arrangement by itself and in combination with the complete combustion chamber arrangement described provides for a more efficient mixture of the fuel and air in the rich combustion chamber than heretofore possible. Additionally, the complete combustion chamber arrangement described assures a thorough combustion of the fuel-air mixture therein while providing efficient cooling of the burner walls and serving as a means to direct the shape of the flame thus propagated. The arrangement disclosed has been found to be particularly stable during operation. For example, the burner illustrated can be ignited at full air flow as opposed to prior art burners which required the air flow therein to be throttled before ignition could occur. Thus the burner described is especially suitable for excess air operation where the air flow to the burner is constant and the fuel regulated therein is varied to arrive at different burner temperatures. The flow of gaseous fuel to the burner may be varied by suitable control valves regulated in accordance with a thermocouple within the enclosure of the tunnel block, all of which are known to those skilled in the art and thus not shown nor described in detail herein.

To achieve a high degree of efficiency and stability in the burner 10 of the present invention, it is desirable to size certain burner dimensions within preferred ranges. That is, given the Btu capacity of the burner to establish the amount of fuel supplied, typically between 250,000 and 8,000,000 Btu/hr., the pressure of the fuel supplied nozzle 47, typically between 0.01 and 3 inches w.c. and the air pressure supplied first chamber 60, generally 6 inches w.c. and the air pressure supplied second chamber 61, generally 2 inches w.c., the following dimensions are preferred:

1. The orifice diameter of gas nozzle 47 should be ⅛ and ¾ inches, rich combustion chamber 41 diameter should be between 2 and 6 inches and complete combustion chamber diameter should be between 4 and 12 inches with the length of rich combustion chamber between 2 and 6 inches and the length of complete combustion chamber between 6 and 18 inches to establish proper theoretical flow line 80 along with other relationships.

2. The axial spacing between port arrays 65, 66 which is felt sufficient to establish an adequate interaction between air flow paths is between 1.5 and 4 inches, which relationship has been determined by test data.

3. The axial distance from rich combustion chamber end wall 45 to the second port array 66 is believed to be a maximum distance of approximately 1 inch and it is further believed by test data to depend also upon the position of nozzle opening 47 which may be spaced with respect to second port array 66 to either be in alignment therewith or set back therefrom (as shown in FIG. 3) a distance between 0 and 1 inches. It is not believed that such distance are linear, and some have been experimentally determined.

4. The aperture area in each array within the complete combustion chamber is a progression such that if the total area in the smallest aperture array be given the value 1.0, the second aperture array would be given a value of 2.0, the third aperture array be given a total area relationship of 3.0, etc. The total area in the first aperture array 64*a* assigned a value of 1.0 would preferably be between 0.15 and 4.5 inches squared.

The values quoted above are believed typical values for the burner capacities illustrated and are cited merely for showing and adequately describing working embodiments of the subject invention.

The invention has been described with reference to a preferred embodiment. Obviously, modifications and alterations will occur to others upon reading and understanding the specification. It is my intention to include all such modifications and alterations insofar as they come within the scope of the present invention.

It is thus the essence of the invention to provide a gas burner having a rich combustion chamber contiguous with a complete combustion chamber and combustion air porting arrangements associated therewith to produce a self-stabilizing flame in a highly efficient manner.

Having thus defined my invention, I claim:

1. A self-stabilizing burner comprising:

a housing defining first and second contiguous chambers therein;

said first chamber being generally cylindrical and having an open exit end and a closed inlet end, said inlet end having a first opening approximately in the center thereof and at least a second opening spaced from said first opening;

said second chamber being larger in cross section than said first chamber over at least a portion thereof and having an exit end in fluid communication with an enclosure to be heated by said burner;

fuel supply means for directing a gaseous fuel under pressure through said first opening in said first chamber to cause said fuel to enter said first chamber generally parallel to the longitudinal axis thereof;

first air supply means for supplying a source of combustion air at a first pressure to said housing;

second air supply means for supplying a source of combustion air at a second pressure to said housing;

first port means within said first housing in fluid communication with said first air supply means for directing said combustion air in axially spaced streams tangential to the walls of said first chamber and generally perpendicular to the flow of said gaseous fuel to cause an underpressure at the center of said first chamber drawing said gaseous fuel radially outwardly and establishing an air layer zone at said inlet end of said first chamber tending to prevent carbon formation at said inlet end of said first chamber;

second port means within said second chamber and in fluid communication with said second air supply means to introduce combustion air radially inwardly into said second chamber to define a positive pressure therein;

said second port means coacting with said first port means to impart a recirculatory motion to a portion of the longitudinally moving portion of said gaseous fuel and air exiting said first chamber whereby said portion is recirculated back into said first chamber; and ignition means extending within said second opening in said inlet end of said first chamber to cause said gaseous fuel and air therein to be ignited.

2. The burner of claim 1 wherein said first port means includes said first chamber having first and second axially spaced tangential openings extending therein, said first tangential opening spaced closely adjacent said first inlet opening in said first chamber.

3. The burner of claim 2 wherein said second chamber is defined as cylindrical in configuration and said second port means includes a plurality of spaced openings extending within said second chamber, said openings circumferentially spaced thereabout in axially displaced arrays, each array successively increasing in total opening area from the smallest area array closest to said first chamber and said first pressure is greater than said second pressure.

4. The burner of claim 1 wherein said housing includes:

first, second and third steel pieces;

said first piece having a flanged end cap section defining said closed inlet end of said first chamber, a cylindrical body section depending from said cap section defining said first chamber and a flanged rearward end section depending from said body section, said end section extending radially outwardly;

said second piece having a cylindrical body section defining said second chamber, an inlet portion of said cylindrical body section received on a portion of said rearward end section of said first piece and a radially-outwardly flanged forward section extending from said inlet portion;

said third piece having a generally cylindrical wall section with a forward flanged end secured to said flanged end cap section of said first piece to define an annular chambers between said first and third pieces, said third piece further having an inwardly extending shoulder generally aligned with said rearward and forward flanged end sections of said first and second pieces respectively and sealed therewith by sealing means to define an annular chamber surrounding said second chamber;

said first air supply means including an inlet port in said third piece in fluid communication with said first chamber; and said second air supply means including an orifice in said wall section of said third piece providing fluid communication between said annular chambers and said inlet port.

5. A self-stabilizing, excess air burner comprising:

a housing section having a longitudinally extending, generally cylindrical body portion, a flanged end at the forward end of said body portion, mounting means at the rear end of said body portion, and an inwardly extending protrusion depending from the inner surface of said body portion at a predetermined axial distance thereat;

a rich combustion chamber section having a generally cylindrical, longitudinally extending wall defining a rich combustion chamber therein, a closed end wall at the forward end of said longitudinal wall including outwardly extending flanges, said end wall having a generally centralized gas nozzle opening and an igniter opening spaced from said nozzle opening extending therethrough, and a flanged end portion outwardly extending from the rearward end of said longitudinal wall, said rearward flange end portion having an annular step formed therein;

a combustion tube section defining a complete combustion chamber therein, said tube having an outwardly extending flange portion at its forward end;

fastener means securing said flanges of said rich combustion chamber end wall to said forward flange end of said housing section to position said flanged end portion at the rear of said rich combustion section closely adjacent to and forward of said protrusion;

sealing means between the inner surface of said body portion of said housing section, the rearward end of said rearward flange end portion of said rich combustion section, and the forward end of outwardly extending flange portion of said combustion tube which abuts against the forward side of said protrusion to define a first annular chamber surrounding said longitudinal wall of said rich combustion chamber, and a second annular chamber surrounding said complete combustion chamber;

air means within said housing, rich combustion chamber and combustion tube chambers to supply combustion air under pressure to said rich combustion chamber and said complete combustion chamber;

means to supply a gaseous fuel to said nozzle opening; and means within said igniter opening to ignite said fuel and air thus supplied.

6. The burner of claim 5 wherein said air means includes a generally cylindrical port extending outwardly said body portion of said housing section to define an air inlet chamber therein, said air inlet chamber in unimpeded fluid communication with said first annular chamber and an orifice through said longitudinal body of said housing section, said orifice in fluid communication with said second annular chamber at one side and in fluid communication with said air inlet chamber at its other side.

7. Burner apparatus comprising:

a housing defining a first cylindrical chamber having a closed inlet end and an open exit end, said closed inlet end having a first opening approximately in the center thereof;

said housing further having first and second axially spaced tangential openings extending therein defining first and second air ports respectively, said first air port orientated in a direction opposite said second air port;

fuel supply means for directing a gaseous fuel under pressure through said first opening to cause said fuel to enter said first chamber generally parallel to the longitudinal axis thereof;

air supply means supplying a source of combustion air at a first pressure to said first and second air ports effective to direct said combustion air tangentially to the walls of said first chamber and generally perpendicular to the flow of said gaseous fuel to cause stoichiometric mixing of a portion of said fuel and air at a stabilization zone approximately midway between said first and second air ports while simultaneously establishing an air layer zone at said closed inlet end tending to prevent carbon formation at said inlet end;

spark means in fluid communication with said first chamber for causing said air and fuel to ignite at said stabilization zone, said air means further effective to cause said mixture once ignited to be self-sustaining; and chamber means in fluid communication with said outlet of said first chamber for propagating said flame produced in said first chamber.

8. Burner apparatus of claim 7 wherein said stabilization zone is effective to insure combustion by said spark means at the operating fuel and air pressures of said apparatus.

9. Burner apparatus of claim 7 wherein said chamber means includes a second chamber larger in cross section than said first chamber and having an exit end in fluid communication with an enclosure to be heated by said apparatus and second air port means within said second chamber in fluid communication with a second air supply means at a different pressure than said first air supply means to introduce combustion air in a predetermined distribution within said second chamber to produce a positive pressure within said second chamber.

* * * * *